US006252490B1

(12) United States Patent
Lin

(10) Patent No.: US 6,252,490 B1
(45) Date of Patent: Jun. 26, 2001

(54) SAFETY PLUG AND SWITCH DEVICE

(76) Inventor: Wen-Jang Lin, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/422,219

(22) Filed: Oct. 21, 1999

(51) Int. Cl.[7] ..... H01H 37/02; H01H 37/32; H01H 37/46; H01H 37/52

(52) U.S. Cl. ..... 337/79; 337/66; 337/68; 337/72; 337/37

(58) Field of Search ..... 337/79, 1, 3, 12–19, 337/16, 36, 37, 53, 59, 62, 66, 68, 72, 75, 85, 89, 101, 111, 112, 113, 140, 332, 376; 200/553–557; 29/622

(56) References Cited

U.S. PATENT DOCUMENTS

| | | | | |
|---|---|---|---|---|
| 3,435,169 | * | 3/1969 | Bienwald et al. | 200/167 |
| 3,562,689 | * | 2/1971 | Bar | 337/77 |
| 3,735,077 | * | 5/1973 | Ohashi | 200/167 A |
| 4,345,233 | * | 8/1982 | Matthies | 337/75 |
| 4,778,967 | * | 10/1988 | Deng | 200/315 |
| 5,012,495 | * | 4/1991 | Munroe et al. | 337/3 |
| 5,079,530 | * | 1/1992 | Tsuchiyama | 335/17 |
| 5,089,799 | * | 2/1992 | Sorenson | 337/68 |
| 5,451,729 | * | 9/1995 | Onderka et al. | 200/18 |
| 5,453,725 | * | 9/1995 | You et al. | 337/68 |
| 5,541,569 | * | 7/1996 | Jang | 337/68 |
| 5,694,106 | * | 12/1997 | Wang | 337/79 |
| 5,760,672 | * | 6/1998 | Wang | 337/79 |
| 5,828,284 | * | 10/1998 | Huang | 337/37 |
| 5,847,638 | * | 12/1998 | Sorenson | 337/380 |
| 5,889,457 | * | 3/1999 | Hsu et al. | 337/59 |
| 5,933,069 | * | 8/1999 | Huang | 337/66 |
| 6,057,751 | * | 5/2000 | Hung et al. | 337/377 |
| 6,072,381 | * | 6/2000 | Yu | 337/37 |

FOREIGN PATENT DOCUMENTS

| | | | | |
|---|---|---|---|---|
| 3400286 | * | 7/1985 | (DE) | H01H/73/30 |
| 4140495 | * | 3/1993 | (DE) | B60J/1/20 |

* cited by examiner

*Primary Examiner*—Leo P. Picard
*Assistant Examiner*—Anatoly Vortman

(57) ABSTRACT

A switch device has a conventional fuseless breaker device, a first conductive blade, a second conductive blade, a fixed plate, and a movable plate. The breaker device has a metal bar having two expansion coefficients, an insulator plate, a safety button, and a coiled spring. The metal bar contacts the first conductive blade. A pressing button which is disposed on the switch device has a first portion and a second portion. A lamp assembly is disposed in the pressing button. The lamp assembly has a break display lamp and a dark display lamp. The break display lamp is disposed in the first portion of the pressing button. The dark display lamp is disposed in the second portion of the pressing button.

1 Claim, 4 Drawing Sheets

SAFETY PLUG AND SWITCH DEVICE

BACKGROUND OF THE INVENTION

The present invention relates to a lamp assembly which is disposed in a switch device. More particularly, the present invention relates to a lamp assembly which is disposed in an electronic device.

A conventional breaker device is often disposed in a main switch box. However, a plurality of branch switches do not have any conventional breaker device.

SUMMARY OF THE INVENTION

An object of the present invention is to provide a dark display lamp which is disposed in a switch device to be operated while overloading.

Another object of the present invention is to provide a break display lamp which is disposed in a switch device to be discontinued while overloading.

Another object of the present invention is to provide a dark display lamp which is disposed in a plug to be operated while overloading.

Another object of the present invention is to provide a break display lamp which is disposed in a plug to be discontinued while overloading.

Accordingly, a switch device comprises a conventional fuseless breaker device, a first conductive blade, a second conductive blade, a fixed plate, and a movable plate connected to the fixed plate. The breaker device comprises a metal bar having two expansion coefficients, an insulator plate disposed in the switch device, a safety button disposed on a top end of the insulator plate, and a coiled spring disposed on an upper portion of the insulator plate. The metal bar contacts the first conductive blade. A pressing button is disposed on the switch device. The pressing button has a first portion and a second portion. A lamp assembly is disposed in the pressing button. The lamp assembly has a break display lamp and a dark display lamp. The break display lamp is disposed in the first portion of the pressing button. The dark display lamp is disposed in the second portion of the pressing button. A pressing pin is disposed in the switch device. A compression spring is disposed in the switch device. A first pin of the break display lamp is connected to the pressing pin and the compression spring. A second pin of the break display lamp is connected to a resistor. A first pin of the dark display lamp is connected to the pressing pin and the compression spring. A second pin of the dark display lamp is connected to the resistor. A third conductive blade is disposed in the switch device. A first connection plate is connected to the resistor. A second connection plate is connected to the resistor. When the pressing button is in the on state, the first connection plate contacts the third conductive blade. The metal bar will be bent and the safety button will be ejected while a current is overloading. The break display lamp will be discontinued. When the pressing button is in the off state, the second connection plate contacts the third conductive blade. The dark display lamp is lightened.

DETAILED DESCRIPTION OF THE INVENTION

Figure 1:
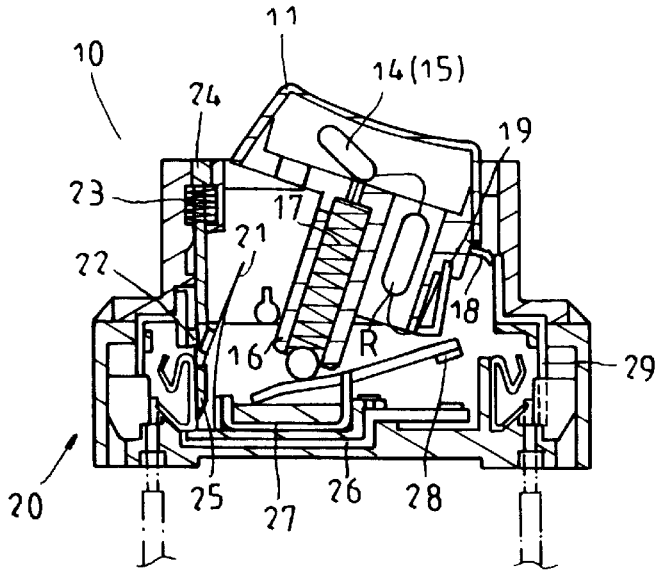
FIG. 1 is a sectional assembly view of a breaker device, a dark display lamp, and a break display lamp disposed in a switch device of a preferred embodiment in accordance with the present invention.
Figure 1A:
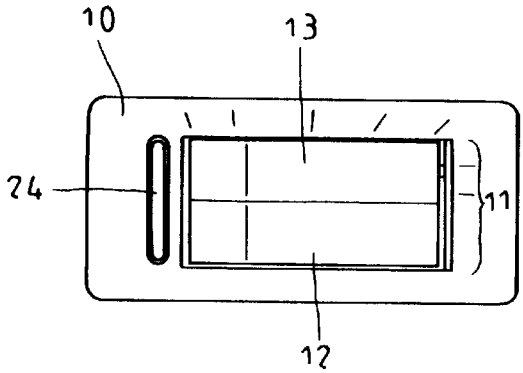
FIG. 1A is a schematic view illustrating an operation of a dark display lamp of a preferred embodiment in accordance with the present invention.
Figure 2:
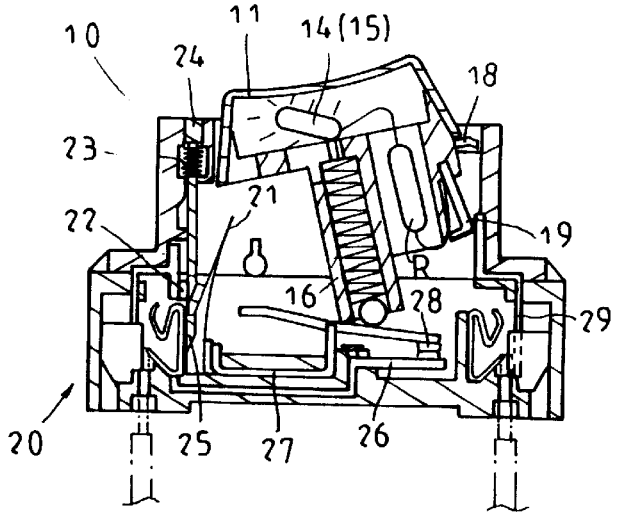
FIG. 2 is a schematic view illustrating an operation of a switch device of a preferred embodiment in accordance with the present invention.
Figure 2A:
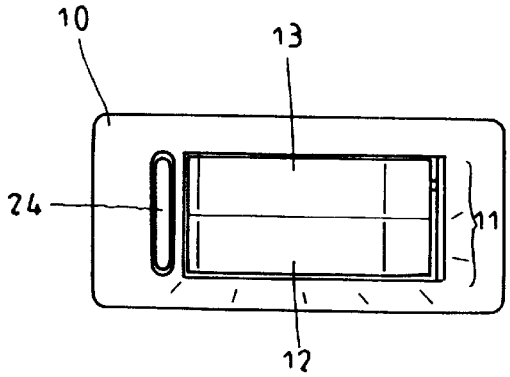
FIG. 2A is a schematic view illustrating an operation of a break display lamp of a preferred embodiment in accordance with the present invention.

Referring to FIGS. 1, 1A, 2 and 2A, a switch device 10 comprises a conventional fuseless breaker device 20, a first conductive blade 22, a second conductive blade 26, a fixed plate 27, and a movable plate 28 connected to the fixed plate 27.

The breaker device 20 comprises a metal bar 21 having two expansion coefficients, an insulator plate 25 disposed in the switch device 10, a safety button 24 disposed on a top end of the insulator plate 25, and a coiled spring 23 disposed on an upper portion of the insulator plate 25.

The metal bar 21 contacts the first conductive blade 22. The metal bar 21 will be bent while overloading. A pressing button 11 is disposed on the switch device 10. The pressing button 11 has a first portion 12 and a second portion 13.

A lamp assembly is disposed in the pressing button 11. The lamp assembly has a break display lamp 14 and a dark display lamp 15. The break display lamp 14 is disposed in the first portion 12 of the pressing button 11. The dark display lamp 15 is disposed in the second portion 13 of the pressing button 11. A pressing pin 16 is disposed in the switch device 10. A compression spring 17 is disposed in the switch device 10.

A first pin of the break display lamp 14 is connected to the pressing pin 16 and the compression spring 17. A second pin of the break display lamp 14 is connected to a resistor R.

A first pin of the dark display lamp 15 is connected to the pressing pin 16 and the compression spring 17. A second pin of the dark display lamp 15 is connected to the resistor R.

A third conductive blade 29 is disposed in the switch device 10.

A first connection plate 18 is connected to the resistor R.

A second connection plate 19 is connected to the resistor R.

Referring to FIG. 1 again, the pressing button 11 is in the on state. The first connection plate 18 contacts the third conductive blade 29. The metal bar 21 will be bent and the safety button 24 will be ejected while a current is overloading. The break display lamp 14 will be discontinued.

Referring to FIG. 2 again, the pressing button 11 is in the off state. The second connection plate 19 contacts the third conductive blade 29. The dark display lamp 15 is lightened.

Figure 3:
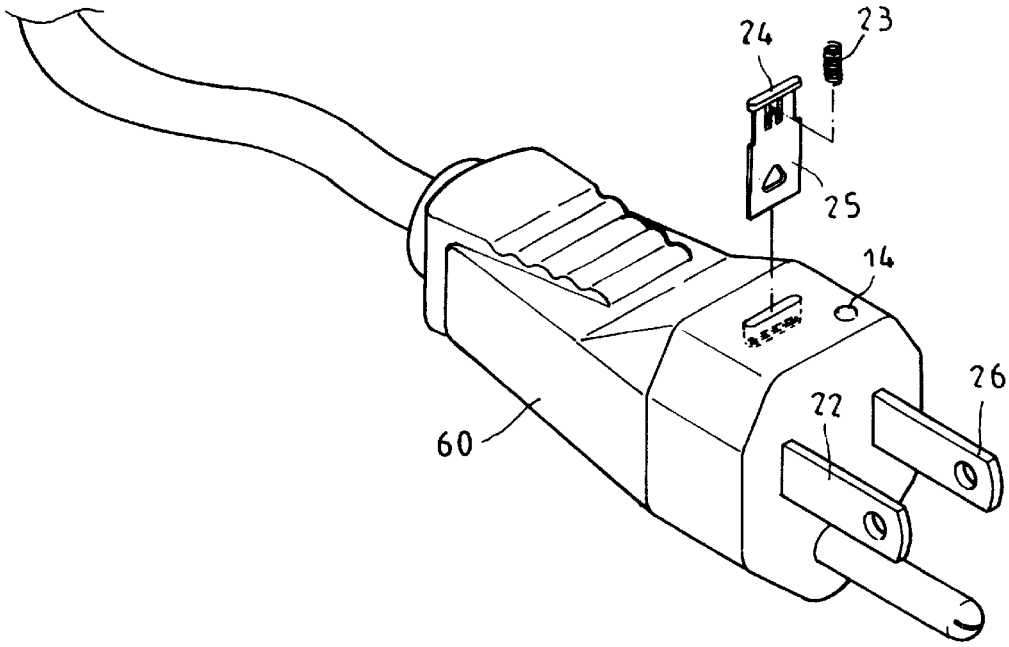
FIG. 3 is a perspective exploded view of a breaker device disposed in a plug of a preferred embodiment in accordance with the present invention.
Figure 3A:
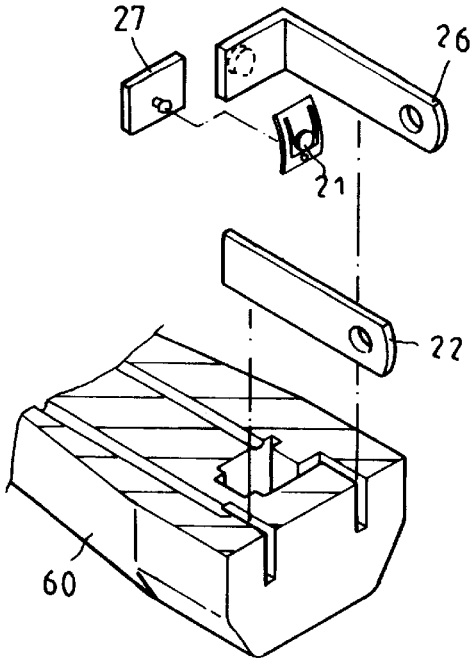
FIG. 3A is a partially perspective exploded view of a plug of a preferred embodiment in accordance with the present invention.
Figure 4:
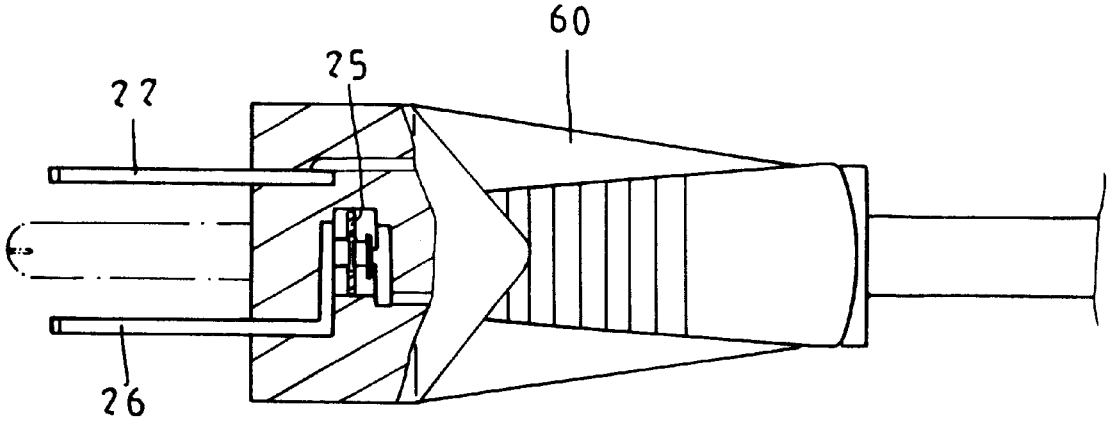
FIG. 4 is a sectional assembly view of a breaker device disposed in a plug of a preferred embodiment in accordance with the present invention.
Figure 5:
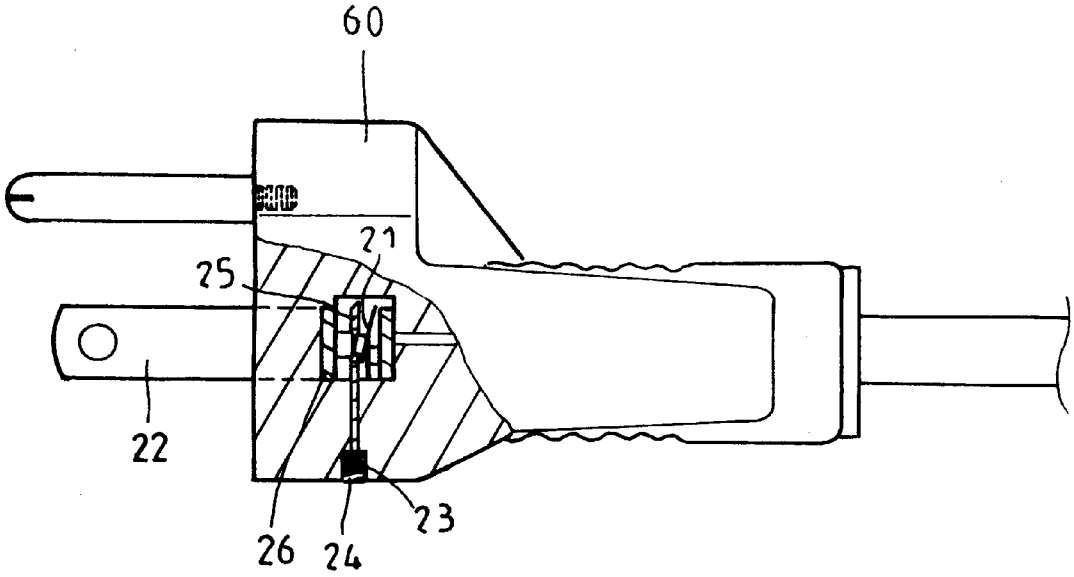
FIG. 5 is another sectional assembly view of a breaker device disposed in a plug of a preferred embodiment in accordance with the present invention.

Referring to FIGS. 3 to 5, a plug 60 comprises a conventional fuseless breaker device, a first conductive blade 22, a second conductive blade 26, and a fixed plate 27.

The breaker device 20 comprises a metal bar 21 having two expansion coefficients, an insulator plate 25 disposed in the switch device 10, a safety button 24 disposed on a top end of the insulator plate 25, and a coiled spring 23 disposed on an upper portion of the insulator plate 25. The metal bar 21 is disposed on the fixed plate 27.

The metal bar 21 contacts the first conductive blade 22. The metal bar 21 will be bent while overloading. A break display lamp 14 is disposed on the plug 60. The metal bar 21 will be bent and the safety button 24 will be ejected while a current is overloading. The break display lamp 14 will be discontinued.

The present invention is not limited to the above embodiments but various modification thereof may be made. Furthermore, various changes in form and detail may be made without departing from the scope of the present invention.

I claim:

1. A switch device comprises:

a conventional fuseless breaker device, a first conductive blade, a second conductive blade, a fixed plate, and a movable plate connected to the fixed plate, the breaker device comprising a metal bar having two expansion coefficients, an insulator plate disposed in the switch device, a safety button disposed on a top end of the insulator plate, and a coiled spring disposed on an upper portion of the insulator plate, the metal bar contacting the first conductive blade, a pressing button disposed on the switch device, the pressing button having a first portion and a second portion, a lamp assembly disposed in the pressing button, the lamp assembly having a break display lamp and a dark display lamp, the break display lamp disposed in the first portion of the pressing button, the dark display lamp disposed in the second portion of the pressing button, a pressing pin disposed in the switch device, a compression spring disposed in the switch device, a first pin of the break display lamp connected to the pressing pin and the compression spring, a second pin of the break display lamp connected to a resistor, a first pin of the dark display lamp connected to the pressing pin and the compression spring, a second pin of the dark display lamp connected to the resistor, a third conductive blade disposed in the switch device, a first connection plate connected to the resistor, a second connection plate connected to the resistor, when the pressing button is in the on state, the first connection plate contacts the third conductive blade, the metal bar will be bent and the safety button will be ejected while a current is overloading, and the break display lamp will be discontinued, when the pressing button is in the off state, the second connection plate contacts the third conductive blade, and the dark display lamp is lightened.

* * * * *